United States Patent [19]

Parlman et al.

[11] 4,321,061

[45] Mar. 23, 1982

[54] MOTOR FUEL

[75] Inventors: Robert M. Parlman; Roy C. Lee; Lyle D. Burns, all of Bartlesville, Okla.

[73] Assignee: Phillips Petroleum Company, Bartlesville, Okla.

[21] Appl. No.: 202,829

[22] Filed: Oct. 31, 1980

[51] Int. Cl.[3] ..... C10L 1/22

[52] U.S. Cl. ..... 44/63; 252/386

[58] Field of Search ..... 44/63; 252/386; 544/358

[56] References Cited

U.S. PATENT DOCUMENTS

| | | | |
|---|---|---|---|
| 3,049,414 | 8/1962 | Kruyff | 44/63 |
| 3,273,980 | 9/1966 | LeSuer et al. | 44/63 |
| 3,322,519 | 5/1967 | Forster | 44/56 |
| 3,628,926 | 12/1971 | Eckert | 44/63 |

*Primary Examiner*—Winston A. Douglas
*Assistant Examiner*—Y. Harris-Smith

[57] ABSTRACT

Liquid hydrocarbon fuel compositions are provided containing antiknock quantities of ashless antiknock additives comprising cyclic diamines selected from 1,4-diazacycloalkanes.

15 Claims, No Drawings

MOTOR FUEL

This invention relates to liquid hydrocarbon fuel compositions having improved antiknock properties. In one of its aspects, this invention relates more particularly to liquid hydrocarbon fuel compositions intended for use in internal combustion engines containing novel and effective ashless antiknock agents. In accordance with a further aspect, this invention relates to liquid hydrocarbon compositions containing antiknock quantities of ashless antiknock agents comprising selected cyclic diamines.

Various antiknock agents have, heretofore, been suggested and employed for use in liquid hydrocarbon fuels, particularly in fuels employed in internal combustion engines. In such engines, it is highly desirable, from a standpoint of economics, that combustion of the fuel occurs at relatively high compression ratios. Such high compression ratios concomitantly necessitate the use of fuels having relatively high octane numbers to insure knock-free operation. Many antiknock agents have been proposed and/or used to improve the antiknock properties of hydrocarbon fuels used for internal combustion engines. In general, however, none of these antiknock additives have proved to be satisfactory in effectively raising the octane number of the fuel without also exhibiting other undesirable properties of varying importance. The phase-down of lead in gasoline as required by federal law and the banning of certain additives from use in unleaded gasoline has given added impetus to continuation of a systematic study of the antiknock activity of ashless (non-metallic) compounds. The most widely known non-leaded antiknock agents include aniline and its alkali derivatives, phenylenediamines, tertiary alkyl ethers, etc. Compounds like phenylenediamine are excellent antiknock compounds but are no longer used because of alleged carcinogenicity.

Aromatic amines such as aniline, aminophenols, etc., where the nitrogen atom is present outside the ring, are widely known as additives in gasoline. Cyclic amines where the nitrogen atoms are present as part of the ring structure are not as widely known as additives in gasoline. In fact, cyclic ring amines (heterocyclics) are not known as antiknock additives in gasoline. The closest art known is U.S. Pat. No. 3,049,414 issued Aug. 14, 1962, which discloses the use of saturated nitrogenous organic bases such as triethylenetetramine (a linear aliphatic amine), piperazines (1,4-diazacyclohexane), etc., as color stabilizers in gasoline. U.S. Pat. No. 3,628,926 issued Dec. 21, 1971, describes the use of cyclic amines such as piperidine added to a petroleum hydrocarbon to prevent microorganism growth. U.S. Pat. No. 3,322,519 issued May 30, 1967, discloses the use of cyclic amines such as piperazine for use as antistatic agents in gasoline. Some of the aforementioned references employ heterocyclic amine compounds wherein only one nitrogen atom is a part of the cyclic structure. None of the references describe the use of these amines as antiknock agents. Thus, the essence of this invention is the use of selected cyclic diamines such as 1,4-diazacycloalkanes as ashless antiknock agents in hydrocarbon fuels.

Accordingly, an object of this invention is to provide ashless hydrocarbon fuel compositions.

Another object of this invention is to provide ashless (non-metallic) antiknock additives for internal combustion engine fuels.

Another object of this invention is to provide hydrocarbon fuel compositions exhibiting improved antiknock properties.

Other objects, aspects, as well as the several advantages of the invention will be apparent to those skilled in the art upon reading the specification and the appended claims.

In accordance with the present invention, new and improved liquid hydrocarbon fuel compositions are provided containing an antiknock quantity of ashless (non-metallic) additives comprising selected cyclic amines such as 1,4-diazocycloalkanes.

Diazacycloalkanes useful in this invention are those compounds represented by the formula

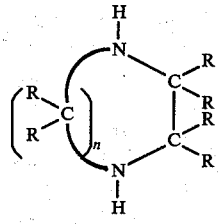

wherein R can be hydrogen or any alkyl radical having from one to six carbon atoms, and n can be 2 or 3. Exemplary of such materials are, for example 1,4-diazacyclohexane (piperazine)
1,4-diaza-2-methylcyclohexane (2-methylpiperazine)
1,4-diaza-3-methylcyclohexane
1,4-diaza-5-methylcyclohexane
1,4-diaza-2-ethylcyclohexane
1,4-diaza-2-propylcyclohexane
1,4-diaza-2-isopropylcyclohexane
1,4-diaza-2-n-butylcyclohexane
1,4-diaza-2-iso-butylcyclohexane
1,4-diaza-2-sec-butylcyclohexane
1,4-diaza-2-tert-butylcyclohexane
1,4-diaza-2-pentylcyclohexane
1,4-diaza-2-hexylcyclohexane
1,4-diaza-2,2-dimethylcyclohexane
1,4-diaza-2,3-dimethylcyclohexane
1,4-diaza-2,5-dimethylcyclohexane
1,4-diaza-2,6-dimethylcyclohexane
1,4-diaza-2,3,5-trimethylcyclohexane
1,4-diaza-2,3,5,6-tetramethylcyclohexane
1,4-diaza-2,2,3,3,5,5,6,6-octamethylcyclohexane
1,4-diaza-2-methyl-3-ethyl-4-propyl-5-hexylcyclohexane
1,4-diazacycloheptane (homopiperazine)
1,4-diaza-2-methylcycloheptane
1,4-diaza-2,7-dimethylcycloheptane
1,4-diaza-2,3,5,6,7-pentamethylcycloheptane
1,4-diaza-2-methyl-3-ethyl-7-propylcycloheptane
and the like and mixtures thereof.

The antiknock additives of the invention are highly suited for use in fuels in view of their ashless characteristics. Naturally, the various compounds of the herein disclosed group do not possess exactly identical effectiveness, and the most advantageous concentration for each such compound will depend to some extent upon the particular compound used. Also, the minimum effective inhibitor concentration can vary somewhat according to the specific nature of the hydrocarbon composition to which it is added.

When the above-named compounds are used as additives in unleaded gasoline, the concentration considered to be most effective when employed as an antiknock is thought to be broadly from 0.1 to 10 wt. percent (1000 to 100,000 parts per million) preferably 0.5 to 5 wt. percent (5000 to 50,000 parts per million).

The inventive piperazine compounds also known as 1,4-diazacycloalkanes can be prepared by various methods among which are described in U.S. Pat. No. 3,037,023 issued May 29, 1962, and U.S. Pat. No. 3,064,001 issued Nov. 13, 1962, wherein alkanolamines or mixtures of alkanolamines with or without alkylenediamines such as ethylene diamine, diethylene triamine, etc., are heated between 150°–400° C. at 65–225 atmospheres in the presence of excess ammonia and hydrogen. Hydrogenation catalysts are used which contain a metal from a group consisting of copper, nickel, cobalt, and their corresponding oxides.

The types of hydrocarbon fuels useful in this invention are any alkylate gasoline, cracked gasolines, polymer gasolines, or the like. Gasoline having 0.1 to 50 wt. percent of constituents convertible into gummy resinous materials are preferred. The hydrocarbon fuel used in this invention is considered to be a typical unleaded gasoline. This base fuel contains little, if any, metals and is comprised of varying amounts of paraffins, olefins, cycloparaffins (naphthenes) and aromatics. General specifications for this type gasoline are disclosed in ASTM D 439-56T. This gasoline contains less than 0.05 wt. percent lead. The amount of volatilizing agent(s) employed will vary to meet specific requirements due to seasons and geographical locations. The characteristics and properties of the unleaded gasoline employed herein are listed as follows:

| Characteristics of Test Gasoline | |
|---|---|
| Designation | FT-175[a] |
| Reid Vapor Pressure, psi | 7.2 |
| API Gravity at 60° F. (15.6° C.) | 64.4 |
| ASTM Distillation | |
| Vol. % Evaporated | Temp., °F. |
| IBP | 86 |
| 5 | 115 |
| 10 | 132 |
| 15 | 145 |
| 20 | 157 |
| 30 | 178 |
| 40 | 197 |
| 50 | 213 |
| 60 | 229 |
| 70 | 250 |
| 80 | 286 |
| 90 | 353 |
| 95 | 391 |
| EP | 428 |
| Lead Content, g/gal | 0.005 |
| Sulfur Content, wt. % | 0.04 |
| Research Octane Number (RON) | 91.5 |
| Motor Octane Number (MON) | 83.9 |
| Component | Vol. % |
| Paraffins | 69.03 |
| Olefins | 15.01 |
| Naphthenes | 6.63 |
| Aromatics | 9.33 |
| Average Molecular Weight | 101.3 |
| Atomic Ratio: Hydrogen/Carbon | 2.10 |
| Stoichiometric Air Feed Ratio | 14.89 |

[a]Unleaded Kansas City Premium Pipeline Base Gasoline from Phillips Petroleum Company The following example illustrates the operability of this invention.

EXAMPLE I

This example illustrates the effectiveness of the 1,4-diazacycloalkanes of this invention as antiknock additives in unleaded gasoline and compares the values obtained with those values obtained when heterocyclic compounds containing only 1 ring nitrogen were used. The antiknock properties were obtained in a manner described in ASTM Method D439-56T using a 0.1 Molar solution of additive in hydrocarbon-based fuel. A 0.1 Molar solution is generally about 1.5 to 2.5 wt. percent depending on the molecular weight of the additive. The data, listed in Table I, show that cyclic compounds containing only one nitrogen atom generally are poor antiknock additives, values ranging from proknock −0.7 to slightly antiknock 0.3 whereas cyclic compounds containing two nitrogen atoms, particularly in the 1- and 4-position exhibit good antiknock properties. The data also show that C-alkyl substitutions (alkyl groups attached to a ring carbon atom) are sometimes beneficial whereas N-alkyl substitutions (alkyl groups attached to a ring nitrogen atom) are detrimental to good antiknock activity.

TABLE I

Antiknock Properties of Ring Nitrogen-Containing Additives (0.1 Molar Concentration) in Unleaded Gasoline[a]

| Compound[b] | Structural Formulas | Δ RON ASTM D 439-56T |
|---|---|---|
| A. Controls | | |
| 1. Pyridine | 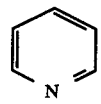 | 0.3 |
| 2. Piperidine | 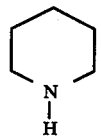 | −0.1 |
| 3. 2,3-Dimethylpiperidine | 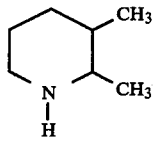 | −0.7 |
| 4. 2,6-Dimethylpiperidine | 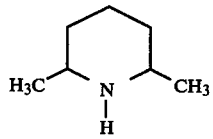 | 0.1 |
| 5. 3,5-Dimethylpiperidine | 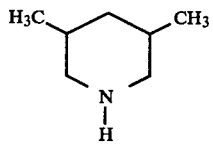 | −0.3 |
| 6. Hexamethyleneimine | 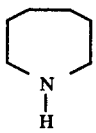 | 0.2 |

TABLE I-continued

Antiknock Properties of Ring Nitrogen-Containing Additives (0.1 Molar Concentration) in Unleaded Gasoline[a]

| Compound[b] | Structural Formulas | Δ RON ASTM D 439-56T |
|---|---|---|
| 7. N-Methylpiperazine | 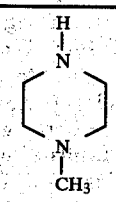 | −0.7 |
| B. Invention | | |
| 8. Piperazine (1,4-Diazacyclohexane) | 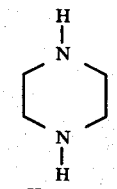 | 0.7 |
| 9. 2-Methylpiperazine | 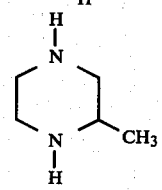 | 1.1 |
| 10. 2,5-Dimethylpiperazine | 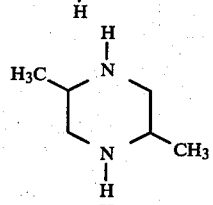 | 0.7 |
| 11. 2,6-Dimethylpiperazine | 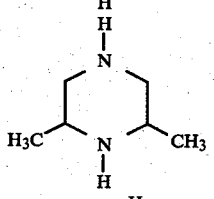 | 0.7 |
| 12. Homopiperazine (1,4-Diazacycloheptane) | 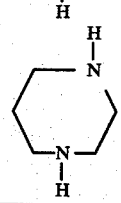 | 1.0 |

[a]Unleaded Kansas City premium pipeline base gasoline (FT-175 which contains 15–16 wt. percent olefins).
[b]Compounds purchased from the Aldrich Chemical Co.

The efficacy of the novel ashless antiknock compounds of the present invention for improving the antiknock properties of liquid hydrocarbon fuels will be apparent from the foregoing examples and comparative data. It will be understood that the novel ashless antiknock compounds of the present invention can be advantageously employed in any liquid hydrocarbon fuel composition which is suitable for use in a combustion engine regardless of the purpose for which the engine is designed.

We claim:

1. An internal combustion fuel composition comprising a major proportion of a motor fuel containing a small but effective amount ranging from about 0.1 to about 10 weight percent, sufficient to impart reduced knocking tendencies to said motor fuel, of an ashless antiknock additive selected from compounds represented by the formula

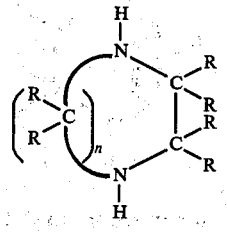

wherein R is hydrogen or an alkyl having from 1–6 carbon atoms, and n is 2 or 3.

2. A composition according to claim 1 wherein said additive is piperazine, 2-methylpiperazine, 2,5-dimethylpiperazine, 2,6-dimethylpiperazine, or homopiperazine (1,4-diazacycloheptane).

3. A composition according to claim 1 wherein the motor fuel is unleaded and contains from about 0.5 to about 5 weight percent of said additive.

4. A composition according to claim 1 wherein the motor fuel is a distillate boiling in the range of about 70° F. to about 420° F. (21.1°–216° C.).

5. A gasoline composition containing an antiknock quantity ranging from about 0.1 to about 10 weight percent of at least one member of the group consisting of antiknock compounds represented by the formula

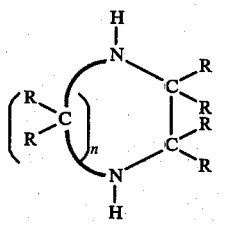

wherein R is hydrogen or an alkyl having from 1–6 carbon atoms, and n is 2 or 3.

6. The composition of claim 5 wherein said gasoline is unleaded.

7. The composition of claim 5 containing from about 0.5 to about 5 percent by weight of the antiknock compound.

8. A composition according to claim 5 wherein said antiknock compound is piperazine, 2-methylpiperazine, 2,5-dimethylpiperazine, 2,6-dimethylpiperazine, or homopiperazine (1,4-diazocycloheptane).

9. A composition according to claim 5 wherein said antiknock compound is 2-methylpiperazine.

10. A composition according to claim 5 wherein said antiknock compound is homopiperazine (1,4-diazacycloheptane).

11. A method for improving the antiknock properties of a motor fuel which comprises incorporating therein a small, but effective amount sufficient to impart reduced knocking tendencies to said motor fuel of an ashless antiknock additive selected from compounds represented by the formula

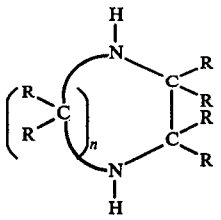

wherein R is hydrogen or an alkyl having from 1-6 carbon atoms, and n is 2 or 3.

12. A method according to claim 11 wherein the motor fuel contains from about 0.1 to about 10 weight percent of said additive.

13. A method according to claim 11 wherein the motor fuel contains from about 0.5 to about 5 percent by weight of said additive.

14. A method according to claim 12 wherein said additive is piperazine, 2-methylpiperazine, 2,5-dimethylpiperazine, 2,6-dimethylpiperazine, or homopiperazine (1,4-diazocycloheptane).

15. A method according to claim 12 wherein the motor fuel is a distillate fuel boiling in the range of about 70° F. to about 420° F. (21.6°-216° C.).

* * * * *